US006707370B2

(12) United States Patent
Ritt et al.

(10) Patent No.: US 6,707,370 B2
(45) Date of Patent: Mar. 16, 2004

(54) THERMAL SWITCH AND HEATER

(75) Inventors: Robert A. Ritt, Palatine, IL (US); Ruben Rivera, Chicago, IL (US)

(73) Assignee: Acra Electric Corporation, Schiller Park, IL (US)

( * ) Notice: Subject to any disclaimer, the term of this patent is extended or adjusted under 35 U.S.C. 154(b) by 0 days.

(21) Appl. No.: 10/134,064

(22) Filed: Apr. 26, 2002

(65) Prior Publication Data

US 2003/0201865 A1 Oct. 30, 2003

(51) Int. Cl.[7] ..... H01H 37/02; H01H 37/32
(52) U.S. Cl. ..... 337/299; 337/412; 337/415
(58) Field of Search ..... 337/4, 13, 298, 337/299, 401, 404, 412, 414, 415, 417; 29/622

(56) References Cited

U.S. PATENT DOCUMENTS 2,611,066 A * 9/1952 Freeman ..... 219/523
2,699,488 A * 1/1955 Arak et al. ..... 392/498
2,780,703 A * 2/1957 Macintyre ..... 338/28
3,564,589 A * 2/1971 Arak ..... 392/498
3,619,565 A * 11/1971 D'Elia et al. ..... 219/523
4,327,281 A * 4/1982 Jager et al. ..... 219/523
4,358,667 A * 11/1982 Johnson et al. ..... 392/498
4,379,220 A * 4/1983 Middleman et al. ..... 392/497
5,392,380 A * 2/1995 Tsai ..... 392/498
5,905,849 A * 5/1999 Ito ..... 392/498

* cited by examiner

*Primary Examiner*—Anatoly Vortman
(74) *Attorney, Agent, or Firm*—Wood, Phillips, Katz, Clark & Mortimer

(57) ABSTRACT

A thermal switch comprises an elongate tubular sealed housing. A control circuit is mounted in the housing. The control circuit comprises a thermostat, a fuse and a thermal overload switch electrically connected in series. An electrical connector is mounted to the housing and is connected to the control circuit.

14 Claims, 2 Drawing Sheets

THERMAL SWITCH AND HEATER

FIELD OF THE INVENTION

This invention relates to a thermal switch and, more particularly, to a thermal switch with integrated over protection circuitry.

BACKGROUND OF THE INVENTION

Heating elements, such as cartridge heaters, are used for various applications, including heating of liquids. Typically, the heater is wired in a control circuit that regulates operation of the heater to maintain a desired temperature. This may be done with a separate temperature or thermal switch.

A thermal switch, such as a thermostat, has a control contact wired in series with the heater to control operation of the heater. The thermostat could be mounted to a vessel holding the liquid. Alternatively, the thermostat could be submerged in the liquid. However, such a thermostat and heater are not protected against malfunction such as high current surges, electrical shorts and overheating of the liquid caused by the heater.

The present invention is directed to improvements in thermal switch assemblies.

SUMMARY OF THE INVENTION

In accordance with the invention there is provided a thermal switch including an integral control circuit.

Broadly, there is disclosed herein a thermal switch comprising an elongate tubular sealed housing. A control circuit is mounted in the sealed housing. The control circuit comprises a thermostat, a fuse and a thermal overload switch electrically connected in series. An electrical connector is mounted to the housing and is connected to the control circuit.

It is a feature of the invention that the housing comprises a metal bushing housing the thermostat and the thermal overload switch. A flexible tube is secured to the metal bushing. The bushing and the flexible are filled with epoxy.

In accordance with one aspect of the invention, a heater is connected to the housing and wired in series in the control circuit. The heater may comprise a cartridge heater brazed to a metal bushing of the housing. The cartridge heater is filled with magnesium oxide.

In accordance with another aspect of the invention, a sealed thermal switch is provided for controlling liquid temperature. The switch comprises an elongate tubular submersible sealed housing. A control circuit mounted in the housing comprises a thermostat, a fuse and a thermal overload switch electrically connected in series. An electrical connector is sealed to the housing and connected to the control circuit.

Further features and advantages of the invention will be readily apparent from the specification and from the drawings.

DETAILED DESCRIPTION OF THE INVENTION

Figure 1:
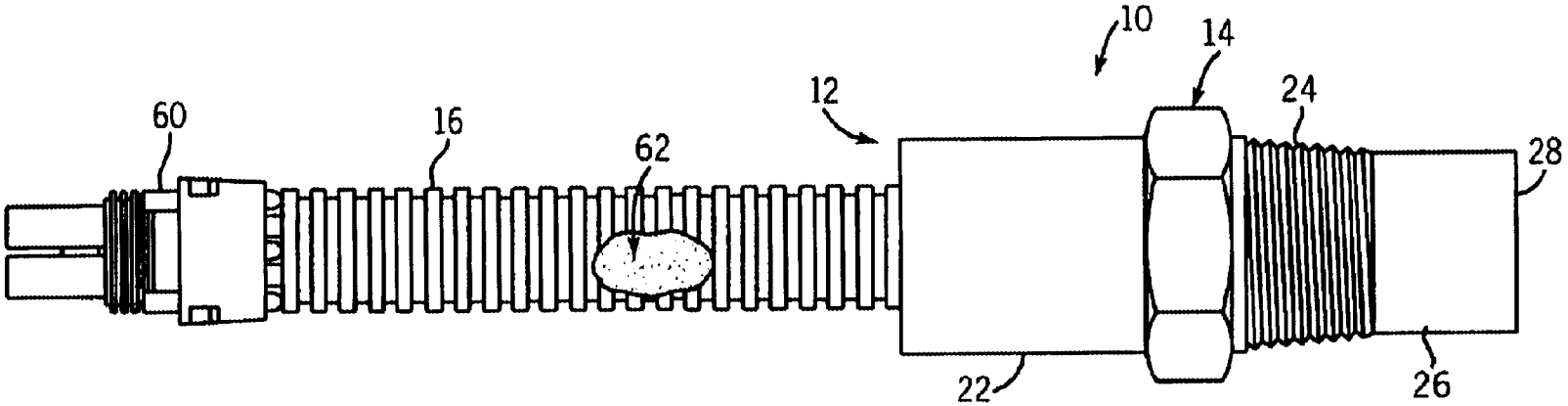
FIG. 1 is a plan view of a thermal switch in accordance with one embodiment of the invention.

Referring to FIG. 1, a thermal switch 10 in accordance with the invention is illustrated. The thermal switch 10 is adapted to not only control temperature but also to protect components that it is controlling from high current surges, electrical shorts and over temperature conditions. The thermal switch 10 is described below for controlling operation of an external heater. As is apparent, the thermal switch could be used for controlling other types of load devices.

The thermal switch 10 includes an elongate tubular sealed housing 12. Particularly, the housing 12 is adapted to be submersible. The housing 12 consists of a metal bushing 14 and flexible tube 16. In the illustrated embodiment of the invention the bushing 14 is brass. The bushing 14 defines an interior space 18, see FIG. 2. A coupling nut portion 20 is disposed between a sleeve 22 and an NPTF threaded portion 24. An opposite side of the threaded portion 24 includes a narrower diameter sleeve 26 closed by an end wall 28. The flexible tube 16 comprises a convoluted tube which may be formed of, for example, PTFE, FEP or PFA. The tube 16 is flexible to allow bends to be formed in the tube, in use, for aligning connections.

Figure 2:
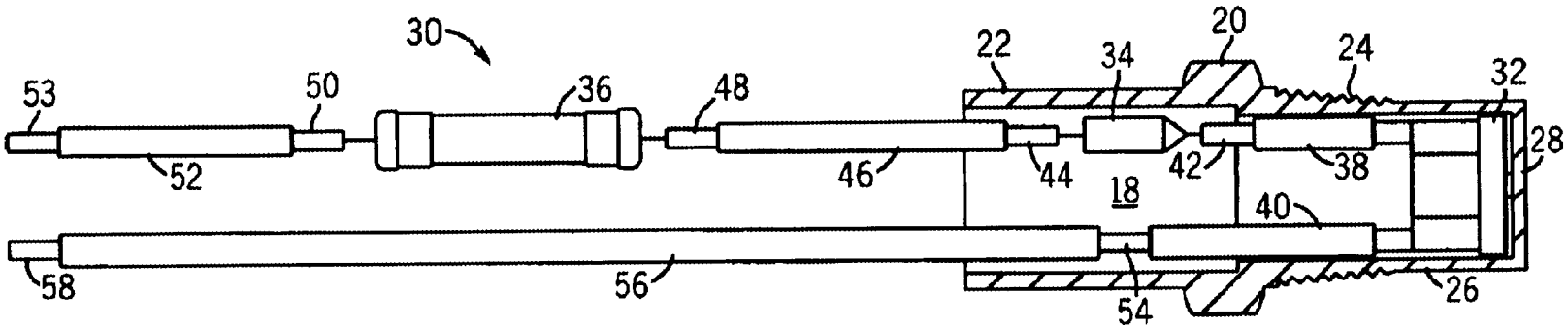
FIG. 2 is a plan view of the switch of FIG. 1 with a bushing shown in section and other parts removed for clarity.

The housing 12 encloses a control circuit 30, see FIG. 2. The control circuit 30 includes a thermostat 32, a thermal cut off switch 34 and a fuse 36. The thermostat 32 is factory preset to open and close an internal contact responsive to sensed temperature. The thermal cut off switch 34 incorporates an encapsulated contact that permanently opens under high temperature conditions. The thermal cut off switch 34 has a trip point higher than the thermostat setting and prevents overheating if, for example, the thermostat 32 fails.

The thermostat 32 is connected between a pair of leads 38 and 40. The first lead 38 is connected via a connector 42 to the thermal cut off switch 34. The opposite side of the thermal cut off switch 34 is connected via a connector 44 to a lead 46. The opposite end of the lead 46 is connected via a connector 48 to the fuse 36. The opposite end of the fuse 36 is in turn connected using a connector 50 to a lead 52 having an exposed opposite end 53. The opposite thermostat lead 40 is connected via a connector 54 to a lead 56 having an exposed opposite end 58. As such, the fuse 36, the thermal cut off switch 34 and the thermostat 32 are connected in series between the exposed lead ends 53 and 58. The exposed lead ends 53 and 58 are electrically connected to an electrical connector 60 for connection to an external circuit.

Prior to installation of an electrical connector 60, the bushing interior space 18 and the convoluted tube 16 are filled with an epoxy 62. The epoxy seals all of the components and secures the convoluted tube 16 to the bushing sleeve 22. Thereafter, the connector 60 is electrically connected to the lead ends 53 and 58 and mechanically secured onto the convoluted tube 16 with a water tight seal in a conventional manner.

In use, the thermal switch 10 is wired in series with an external heater. For example, the electrical connector 60 is connected between a power source and an external heater. As a result, the thermostat 32, thermal overload or cut off switch 34 and the fuse 36 are in series with the external heater. The rating of the thermostat 32 and the proper temperature setting are user selected. The thermostat 32 is thus operable, in use, to selectively energize an external heater and thus control heat. The fuse 36 is selected with a slightly higher rater than the amperage of the heater or other device that is controlled. The fuse 36 eliminates premature failures of the heater or device that are due to voltages causing surge currents or due to short circuit conditions. The thermal cut off switch 34 is selected to have an over temperature cut out (OTC) to prevent and protect the device being heated from damage due to over heating. If this occurs, the thermal cut off switch 34 will open causing the unit to shut down. Once the thermal cut off switch 34 or the fuse 36 trips, then the thermal switch 10 must be replaced. Thus the thermal switch 10 acts as a safety device.

As is apparent, the particular type and lengths of leads and types of connectors can be selected according to desired specifications.

In accordance with the invention, the thermal switch 10 is adapted to control temperature and to protect the components being controlled from high current surges, electrical shorts and over temperature conditions.

Figure 3:
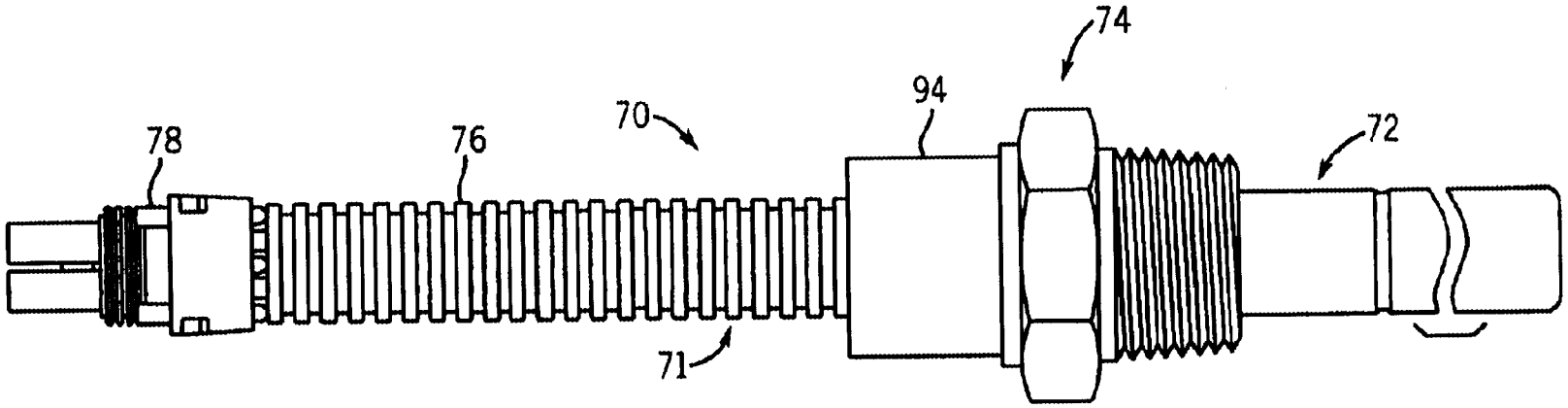
FIG. 3 is a plan view of a thermal switch in accordance with an alternative embodiment to the invention including an integral heater.
Figure 4:
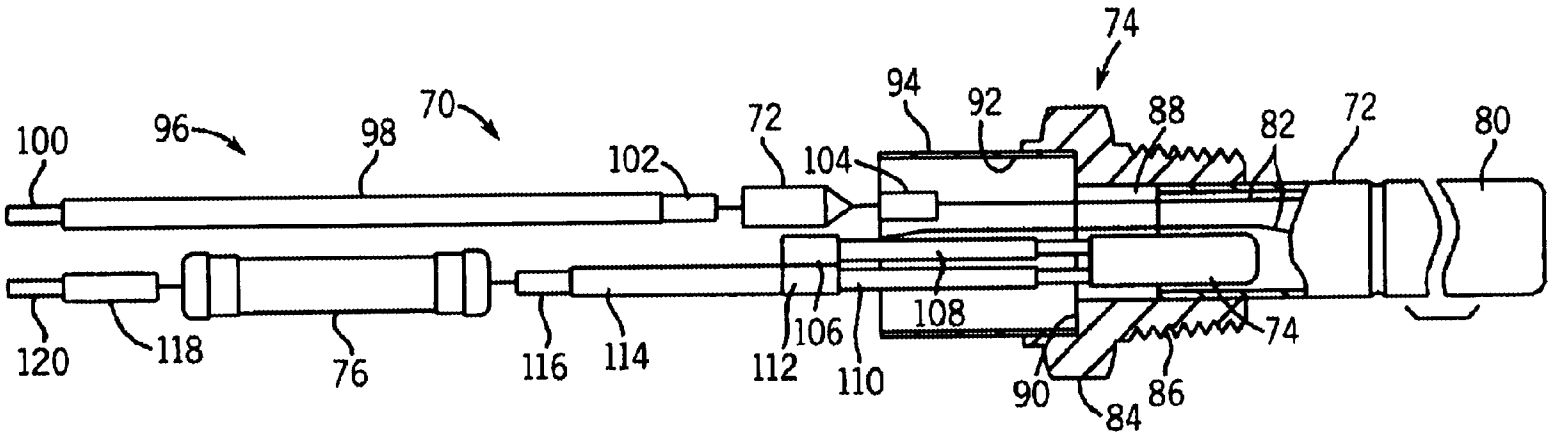
FIG. 4 is a view similar to FIG. 2 for the thermal switch and heater of FIG. 3.

Referring to FIGS. 3 and 4, a temperature controlled heater 70 is illustrated. The temperature controlled heater 70 comprises a cartridge heater integrally formed with a thermal switch that is generally similar to the thermal switch 12 of FIG. 1.

The temperature controlled heater 70 includes an elongate tubular sealed housing 71, a heater 72, and an electrical connector 78. Particularly, the housing 71 is adapted to be submersible. The sealed housing comprises a metal bushing 74 and a convoluted tube 76.

The heater 72 comprises a cartridge heater which may be similar to that described in Rysemus, U.S. Pat. No. 5,486,682, assigned to the assignee of the present application, the specification of which is incorporated by reference herein. Such a cartridge heater includes a cylindrical swaged sheath 80 housing the heating element (not shown) in the form of an electrical resistance wire having exit leads 82. The sheath 80 is filled with magnesium oxide.

The bushing 74 includes a coupling nut portion 84 connected to an NPTF threaded portion 86. The bushing 74 includes a through opening 88 with an internal shoulder 90 connecting a counter bore 92. The through opening 88 receives the cartridge heater 72 which is connected thereto as by brazing. A stainless steel sleeve 94 is received in the counter bore 92 and abuts the shoulder 90 and is secured to the bushing with a subsequent epoxy fill. As is apparent, the sleeve 94 could be integral with the bushing 74 as in the embodiment of FIG. 1.

The temperature controlled heater 70 includes a control circuit 96 enclosed in the housing 71. The control circuit 96 includes a thermal cut off switch 72, a thermostat 74 and a fuse 76. The thermal cut off switch 72 is generally similar to the thermal cut off switch 34 of FIG. 2. Likewise, the fuse 76 is generally similar to fuse 36 of FIG. 2. The thermostat 74 is generally similar to the thermostat 32 of FIG. 2, albeit being of a longer and narrower configuration in the illustrated embodiment. The control circuit 96 further includes a lead 98 having an exposed end 100. An opposite end is connected via a connector 102 to the thermal cut off switch 72. The opposite side of the thermal cut off switch 72 is connected via a connector 104 to one of the heater leads 82. The opposite heater lead 82 is connected via a connector 106 to a first lead 108 of the thermostat 74. Another thermostat lead 110 is connected via a connector 112 to a lead 114. The lead 114 is connected via a connector 116 to the fuse 76. The fuse 76 is connected to a lead 118 having an exposed end 120. The lead exposed ends 100 and 120 are electrically connected to the electrical connector 78. As with the embodiment of FIG. 1, the interior space of the convoluted tube 76, sleeve 94, bushing 74 and the internal end of the heater 80 are filled with epoxy to seal the housing 71 and secure the convoluted tube 76, the sleeve 94 and the bushing 74 together.

In the described embodiment of the invention, the magnesium oxide of the cartridge heater 80 acts as a barrier between the heating element and the thermostat 74. As such, the thermostat 74 is operable to sense temperature of the fluid surrounding the bushing 74. As is described above, the temperature controlled heater 70 uses similar components as the thermal switch 10 of FIG. 1 with the exception that the control circuit 96 is an integral element with the heater 72. Temperature and current ratings are selected similarly to the thermal switch 10 of FIG. 1.

Thus, in accordance with the invention, there is provided a thermal switch, with and without an integral heater, adapted not only to control temperature but protect components it is controlling from high current surges, electrical shorts and over temperature conditions.

We claim:

1. A thermal switch comprising:

an elongate tubular sealed housing;

a control circuit mounted in the sealed housing comprising a thermostat, a fuse and a thermal overload switch electrically connected in series; and an electrical connector mounted to the housing and connected to the control circuit, wherein the housing comprises a metal bushing housing the thermostat and a flexible tube secured to the metal bushing.

2. The thermal switch of claim 1 wherein the bushing and the flexible tube are filed with epoxy.

3. The thermal switch of claim 1 wherein the electrical connector is sealed to the flexible tube.

4. The thermal switch of claim 1 wherein the thermal overload switch is housed in the bushing.

5. The thermal switch of claim 1 wherein the bushing comprises a brass bushing.

6. A thermal switch comprising:

an elongate tubular sealed housing;

a control circuit mounted in the sealed housing comprising a thermostat, a fuse and a thermal overload switch electrically connected in series;

a cartridge heater connected to the housing and wired in series in the control circuit; and an electrical connector mounted to the housing and connected to the control circuit, wherein the housing comprises a metal bushing housing the thermostat and the cartridge heater is brazed to the metal bushing.

7. The thermal switch of claim 6 wherein the cartridge heater is filled with magnesium oxide.

8. A sealed thermal switch for controlling liquid temperature comprising:

an elongate tubular submersible sealed housing;

a control circuit mounted in the housing comprising a thermostat, a fuse and a thermal overload switch electrically connected in series; and an electrical connector sealed to the housing and connected to the control circuits, wherein the housing comprises a metal bushing housing the thermostat and a flexible tube secured to the metal bushing.

9. The sealed thermal switch of claim 8 wherein the bushing and the flexible tube are filed with epoxy.

10. The sealed thermal switch of claim 8 wherein the electrical connector is sealed to the flexible tube.

11. The sealed thermal switch of claim 8 wherein the thermal overload switch is housed in the bushing.

12. The scaled thermal switch of claim 8 wherein the bushing comprises a brass bushing.

13. A sealed thermal switch for controlling liquid temperature comprising:

an elongate tubular submersible sealed housing;

a control circuit mounted in the housing comprising a thermostat, a fuse and a thermal overload switch electrically connected in series; and a cartridge heater connected to the housing and wired in series in the control circuit;

an electrical connector scaled to the housing and connected to the control circuit, wherein the housing comprises a metal bushing housing the thermostat and the cartridge heater is brazed to the metal bushing.

14. The sealed thermal switch of claim 13 wherein the cartridge heater is filled with magnesium oxide.

* * * * *